United States Patent [19]

Brockhaus

[11] Patent Number: 4,524,740

[45] Date of Patent: Jun. 25, 1985

[54] COUPLING MEANS BETWEEN AN OUTPUT CONTROL MEMBER OF AN INTERNAL COMBUSTION ENGINE AND AN ACTUATOR MEMBER

[75] Inventor: Herbert Brockhaus, Wettstetten, Fed. Rep. of Germany

[73] Assignee: Audi NsU Auto Union AG., Ingolstadt, Fed. Rep. of Germany

[21] Appl. No.: 480,948

[22] PCT Filed: Jul. 28, 1982

[86] PCT No.: PCT/DE82/00157

§ 371 Date: Mar. 24, 1983

§ 102(e) Date: Mar. 24, 1983

[87] PCT Pub. No.: WO83/00534

PCT Pub. Date: Feb. 17, 1983

[30] Foreign Application Priority Data

Aug. 8, 1981 [DE] Fed. Rep. of Germany ..... 3131553

[51] Int. Cl.[3] ..... F02D 9/00

[52] U.S. Cl. ..... 123/340; 123/342; 123/357; 123/361

[58] Field of Search ..... 123/342, 376, 396, 400, 123/340, 357, 361

[56] References Cited

U.S. PATENT DOCUMENTS

| | | | |
|---|---|---|---|
| 3,217,827 | 11/1965 | Pickles | 123/361 |
| 3,348,626 | 10/1967 | Thorner | 123/340 |
| 3,721,309 | 3/1973 | Donaldson | 123/376 |
| 4,210,110 | 7/1980 | Krebaum et al. | 123/396 |
| 4,362,138 | 12/1982 | Krueger et al. | 123/342 |
| 4,453,516 | 6/1984 | Filsinger | 123/357 |

*Primary Examiner*—William A. Cuchlinski, Jr.
*Attorney, Agent, or Firm*—Karl Hormann

[57] ABSTRACT

The invention relates to a coupling means between an output control member of an internal combustion engine, in particular for automotive vehicles, and an actuator member, which coupling means in the range of small actuations of the actuator member does not open the output control member at all or only slightly, and only at larger actuations does it open the output control member in a noticeable fashion and thereafter moves it into a full-load position. Such a coupling means makes possible an enlarged operative range for a control device which controls the output control member in dependency of the position of the actuator member and at least one operating parameter of the internal combustion engine in a range lying between the full-load position and the minimum opening position determined by the given position of the actuator member.

9 Claims, 3 Drawing Figures

COUPLING MEANS BETWEEN AN OUTPUT CONTROL MEMBER OF AN INTERNAL COMBUSTION ENGINE AND AN ACTUATOR MEMBER

TECHNICAL FIELD

The invention relates to a coupling means between an output control member of an internal combustion engine and an actuator member. This coupling means is provided for use with actuator members which actuate a servomotor by way of an electronic control unit. The servomotor controls the output control member of the internal combustion engine.

BACKGROUND ART

Energy conservation has lately acquired increasing significance. In conventional internal combustion engines of automotive vehicles an actuator member, commonly the accelerator pedal, is usually rigidly connected to an output control member. In gasoline engines the output control member is as a rule a throttle valve; in Diesel engines it is the control plunger. Owing to this rigid connection there exists a definite relationship between the position of the actuator member and the position of the output control member. This definite relationship is disadvantageous in that the internal combustion engine is driven more or less frequently at unfavorable operating conditions at which it operates at a relatively high specific fuel consumption.

With a view to avoiding this disadvantage German patent specification DE-OS No. 29 26 105 proposes a coupling means of the kind under consideration in which the accelerator pedal is connected to the throttle valve by means of a Bowden wire, the throttle valve being additionally actuated by a servomotor which is controlled by an electronic control unit.

This arrangement is such that with increasing actuation of the accelerator pedal the throttle valve may increasingly be moved to its open position, the position of the accelerator pedal determining the minimum opening of the throttle valve. The servo motor, except when the valve is fully open, may move the valve from any opening to a wider opening which results in slackening of the Bowden cable. This prior art arrangement brings about an initial acceleration of the internal combustion engine in accordance with the position of the throttle valve as set by the accelerator pedal. As soon thereafter as a consumption efficient curve in a torque performance graph stored within the electronic control unit is reached, the throttle valve is automatically opened further by the servomotor in such a manner that the internal combustion engine accelerates further along this chosen consumption efficient curve.

One characteristic of this known device resides in the fact that the electronic control unit cannot move the throttle valve to its closed or slightly open position when the accelerator pedal is positioned at mid-range, for instance. Because of this the operative range of the electronic control unit is limited.

DISCLOSURE OF THE INVENTION

The task of the invention lies in further to develop a coupling means of this kind in such a manner that in spite of the given direct connection between the actuator member and the output control member, which assures operability of the internal combustion engine even when the electronic control unit is defective, as broad an operative range as possible is provided for the electronic control unit.

The task is accomplished by the elements defined in claim 1.

By means of the coupling of the invention provided between the actuator member and the output control member, the minimum opening of the output control member determined by the mechanical connecting means is reduced in accordance with the position of the actuator member so that the range of openings of the output control member between a given minimum opening and the fully open position as determined by the electronic control is increased. Thus, the possible operating range of the electronic control unit is increased without giving rise to the possibility that the internal combustion engine is no longer controllable by the actuator member in case of failure of the control unit. In such circumstances the controllability is merely rendered slightly less precise by the coupling means of the invention.

Claims 2 and 3 are directed to advantageous embodiments of the coupling means.

BEST MODE FOR CARRYING OUT THE INVENTION

Figure 1:
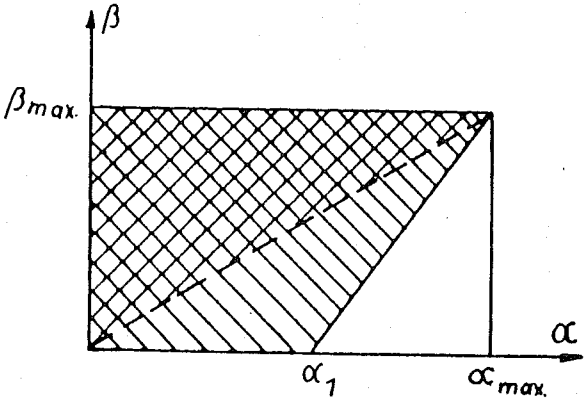
FIG. 1 is a diagram of the possible operating range of the control unit.

The angle $\alpha$ shown on the abscissa in FIG. 1 represents a measure of the actuation of the actuator member, and the angle $\beta$ shown on the ordinate is a measure of the position of the output control member of an internal combustion engine. $\alpha_{max}$ represents the maximum actuation of the actuator member. $\beta_{max}$ depicts the fully open position of the output control member. The broken line represents the conventional relationship between the position of the actuator member and the position of the output control member. This relationship may be in linear one or a progressive one, or may be adjustable in any manner to suit given requirements. The cross-hatched area depicts the operative range of a electronic control unit which in dependency of different operating parameters of the internal combustion engine and the position of the actuator member, as the case may be, opens the output control member beyond the position indicated by a given position of the actuator member. The straight line extending from $\alpha_1$ to the intersection of $\alpha_{max}$ and $\beta_{max}$ represents an example of the connection provided in accordance with the invention between the position of the actuator member and the position of the output control member.

Actuating the actuator member up to the angle $\alpha_1$ results in no opening of the output control member at all. By actuating the actuator member from $\alpha_1$ to $\alpha_{max}$ the output control member becomes fully opened. The possible operating range of a control unit is enlarged by the area depicted by single line hatching.

Figure 2:
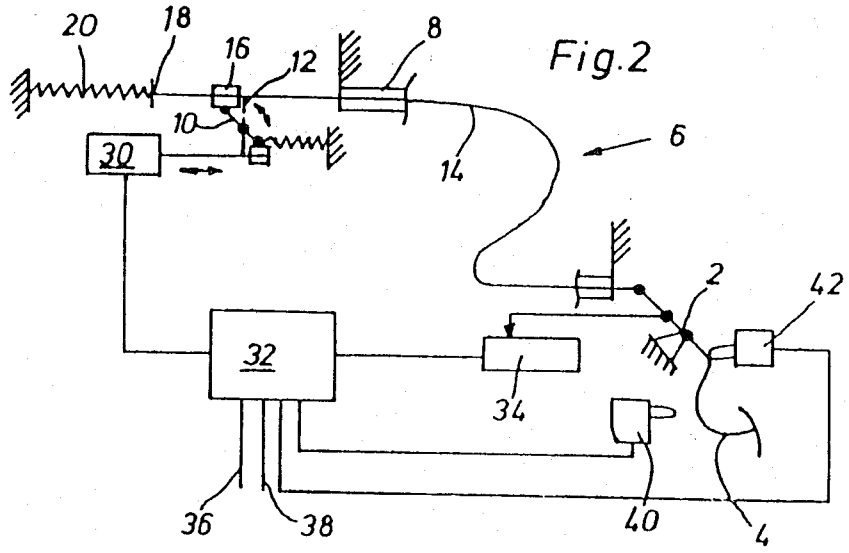
FIG. 2 is a schematic view of the control of an output control member.
Figure 3:
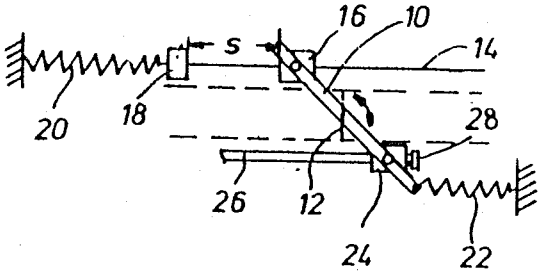
FIG. 3 is an enlarged section taken from FIG. 2.

FIG. 2 illustrates an embodiment of a coupling device by means of which the enlarged operating range described can be achieved. As shown in FIG. 2 an accelerator pedal 4 which is pivotably mounted at 2 is connected to a lever 10 by a Bowden wire 6 the anchored sleeve 8 of which is not fully shown. The lever 10 is connected to a throttle valve 12 of an internal combustion engine (not shown) for rotation therewith. To this end a cable 14 of the Bowden wire 6 slideably extends through a bushing 16 affixed to the lever 10. The end of the cable 14 is provided with a lug 18 for rotating the lever 10 in a clockwise direction as shown in FIGS. 2 and 3, thus opening the throttle valve 12 upon engagement with the bushing 16. A return spring 20 is affixed to the lug 18 for biasing the accelerator pedal 4 into an unchanging idling position.

A return spring 22 is attached to the lever 10 for biasing the throttle valve 12 into its closed, i.e. idling position.

In the idling position as shown, in which the throttle valve 12 is fully closed and the accelerator pedal 4 is not actuated there exists between the lug 18 and the bushing 16 lost motion connection providing for a free flow by an extent marked s, which approximately corresponds to the distance by which the lug 18 is moved when the accelerator pedal 4 is actuated to the extent of the angle $\alpha_1$ which corresponds to about half of the distance by which the accelerator pedal 4 can be moved. When the accelerator pedal 4 is moved from $\alpha_1$ to $\alpha_{max}$ the throttle valve 12 is moved to its fully open position by the lug 18.

At the other end of the lever 10 there is affixed a further bushing 24 through which an actuator rod 26 extends for slideable movement. The actuator rod 26 is provided at its free end with a lug 28. The actuator rod 26 is slideably movable by a servomotor 30 controlled by an electronic control device 32.

The electronic control device 32 is connected to a variable resistor or potentiometer 34 which senses the position of the accelerator pedal 4.

Further inputs 36 and 38 of the control device 32 may for instance be connected to a revolution probe and a temperature sensor or a suction tube pressure sensor of the internal combustion engine (not shown). Further inputs of the control device are connected to a switch 40 responsive to full speed and a switch 42 responsive to idling.

The arrangement described operates in the following manner: When the accelerator pedal 4 is rotated by a predetermined angle $\alpha$ the throttle valve 12 (FIG. 1) is moved into an opening position determined by the extent of rotation or depression of the accelerator 4. The electronic control device 32 controls the servomotor 30 in accordance with a value stored in it, the value depending on given operating parameters of the internal combustion engine and, in the described embodiment, additionally on the position of the accelerator 4. Owing to the face that initially the throttle valve 12 is not opened at all by the mechanical action of the accelerator 4, the operating range of the electronic control device 32 is extraordinarily large.

The electronic control device 32 and its operating mode are not the subject of this invention. Therefore, the control device 32 is not described further. For instance, programs may be stored in the control device 32 which provide for a smooth yet consumption efficient acceleration of the internal combustion engine, even where the accelerator is depressed abruptly, and which assign to any given position of the accelerator 4 a predetermined desired number of revolutions of the internal combustion engine, or desired speed of the vehicle, etc.

INDUSTRIAL APPLICABILITY

The invention may be used for the control of internal combustion engines, particularly in automotive vehicles. It is equally applicable to spark-ignited combustion engines and to Diesel engines; in the latter case the output control member is provided by the control plunger of an injection pump instead of the throttle valve 12. In that case the device makes possible, for instance, that with an abrupt actuation of the accelerator pedal the control plunger, in dependency of the operating parameters of the internal combustion engine, is moved less abruptly in order to prevent smoking of the engine.

It will be apparent that the device described may also be used in marine engines and stationary engines.

I claim:

1. Coupling means between a throttle valve member of an internal combustion engine and a manually moveable actuator member, the internal combustion engine comprising electronic control means for controlling the movement of the throttle valve member in dependency of the position of the actuator member and at least one operating parameter of the internal combustion engine within a range lying between a full-load position and a minimum opening, the coupling means moving the throttle valve member to its full-load position when the actuator is fully actuated, the coupling means comprising a mechanical connection including a lost-motion connection between the actuator member and the throttle valve member which connection for a given change in position of the actuator member in the range of small actuations associates a smaller change in position of the throttle valve member than for a given change in the position of the actuator member in the range of larger actuations, whereby the lost-motion connection is operative within about the first half of the range of actuation of the actuator member, and the mechanical connection provides a mechanical override means for the control device within about the second half of the range of actuation of the actuator member.

2. The coupling means in accordance with claim 1, wherein within about the first half of the range of actuation of the actuator member the lost-motion connection provides a free flow between the actuator member and the throttle valve member.

3. The coupling means in accordance with claim 2, wherein the lost-motion connection comprises a bushing connected to the throttle valve member in a motion transferring manner, the bushing slidably receiving a cable connected with the actuator member and provided with a lug fixedly mounted on the cable at a predetermined distance from the bushing opposite the actuator member for transferring motion between the actuator member and the throttle valve member within about the second half of the range of actuation of the actuator member.

4. Apparatus for controlling the output of an internal combustion engine, comprising:

unitary means moveable between closed and open positions, the output of the internal combustion engine being being a function of the extent of movement of the unitary means between its closed and open positions;

means manually moveable between first and second positions for transferring motion to the unitary means;

means connected the manually moveable means and responsive to the movement thereof for generating an output signal representative of the extent of movement of the manually moveable means;

electronic control means connected to the unitary means and responsive to the output signal for moving the unitary means as a function of the output signal; and mechanical means for connecting the manually moveable means to the unitary means, the connecting means comprising a lost-motion connection for transferring substantially less motion to the unitary means during an initial portion of the movement of the manually moveable means than during a terminal portion of movement of the manually moveable means between its first and second positions, whereby the manually moveable means in the terminal portion of its movement provides means for mechanically overriding the electronic control means.

5. The apparatus of claim 4, wherein the unitary means is the throttle valve of a carburator.

6. The apparatus of claim 4, wherein the unitary means is the plunger of a fuel injection pump.

7. The apparatus of claim 4, wherein the means for generating an output signal is a potentiometer the output of which is connected to the electronic control means.

8. The apparatus of claim 7, wherein the output of the potentiometer is related to the position of the manually movable member at least during the initial range of movement thereof.

9. The apparatus of claim 4, wherein the electronic control means comprises means for storing values related to operating parameters of the internal combustion engine for controlling the position of the unitary means in accordance with the operating parameters.

* * * * *